United States Patent [19]

Newsome

[11] 4,076,241

[45] Feb. 28, 1978

[54] SPORTS RACKET

[76] Inventor: Ernest L. Newsome, 6 Densmore Ave., Auburn, N.Y. 13021

[21] Appl. No.: 704,386

[22] Filed: Jul. 12, 1976

[51] Int. Cl.[2] ..... A63B 51/06

[52] U.S. Cl. ..... 273/73 D

[58] Field of Search ..... 273/73 R, 73 A, 73 C, 273/73 D, 73 E, 175, 67 R, 96 R, 96 D, 29 A

[56] References Cited

U.S. PATENT DOCUMENTS

| | | | |
|---|---|---|---|
| 1,211,708 | 1/1917 | Hudson | 273/175 |
| 1,502,845 | 7/1924 | Blache | 273/73 D |
| 1,674,173 | 6/1928 | Haupt | 273/175 |
| 1,975,341 | 10/1934 | Young | 273/175 X |

FOREIGN PATENT DOCUMENTS

| | | | |
|---|---|---|---|
| 855,902 | 2/1940 | France | 273/73 D |
| 543,411 | 2/1932 | Germany | 273/67 R |
| 2,255 of | 1881 | United Kingdom | 273/73 D |
| 223,151 | 10/1924 | United Kingdom | 273/73 D |
| 11,774 of | 1884 | United Kingdom | 273/73 D |
| 3,471 of | 1902 | United Kingdom | 273/73 D |

*Primary Examiner*—Richard J. Apley

*Attorney, Agent, or Firm*—Brady, O'Boyle & Gates

[57] ABSTRACT

A sports racket having a head including a frame within which is strung a plurality of string elements interconnected in such a manner to provide substantially concave ball-engaging surfaces on each face of the racket head.

5 Claims, 9 Drawing Figures

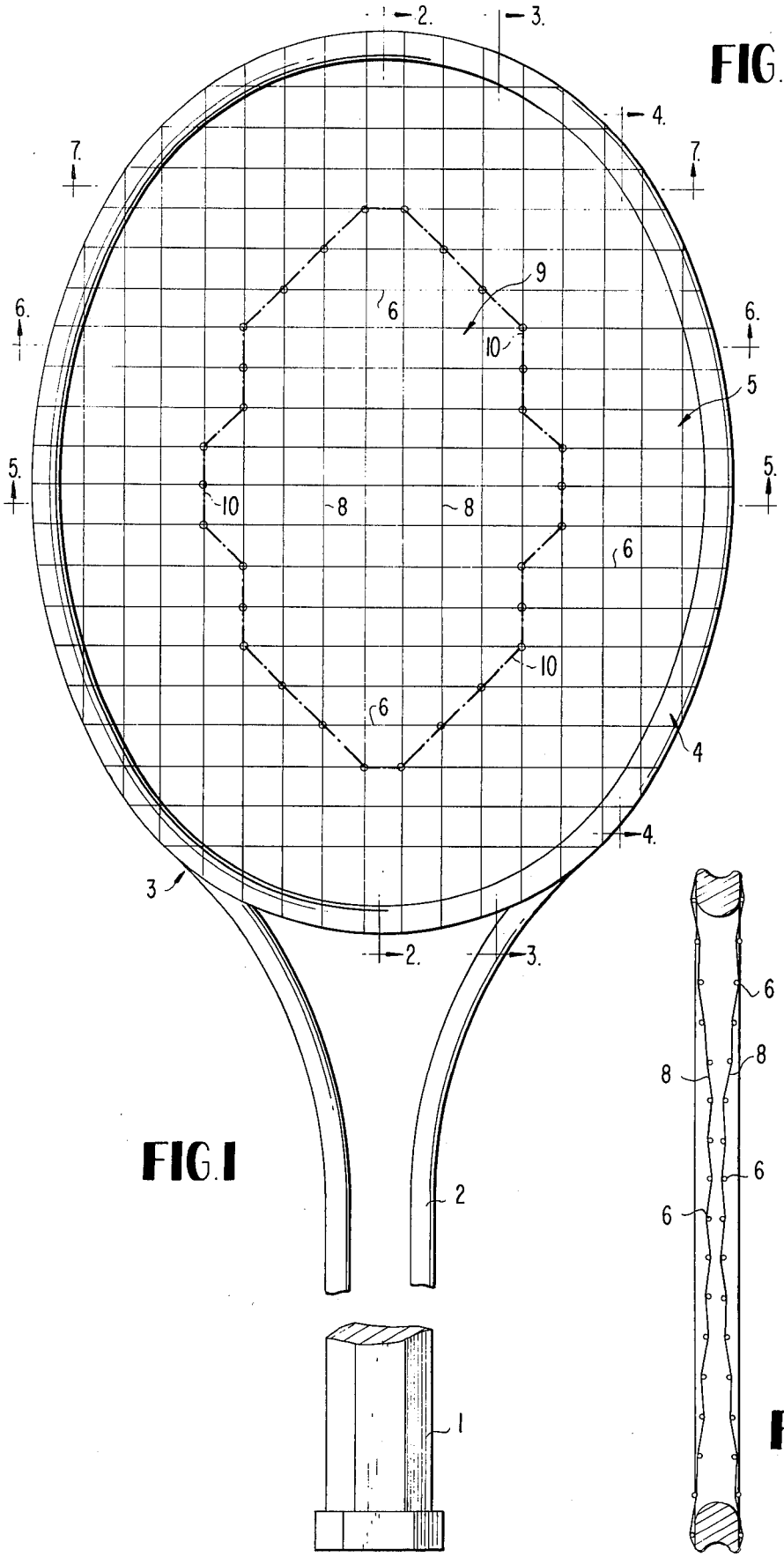
FIG. 1
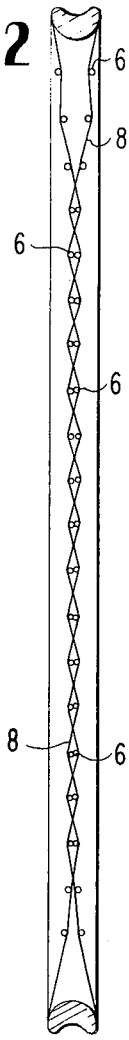
FIG. 2
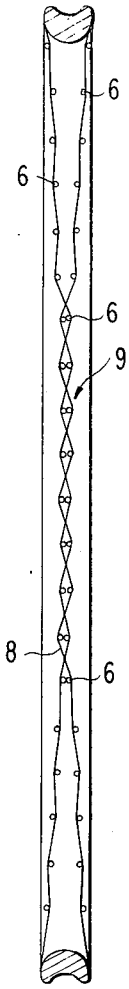
FIG. 3
FIG. 4

SPORTS RACKET

BACKGROUND OF THE INVENTION

In conventional strung rackets, such as tennis rackets, a plurality of string elements are interwoven within a frame to provide a substantially flat ball-engaging surface. In using the racket, many players hit the ball nearer the frame than the center, or sweet spot, resulting in a twisting of the racket in the player's hand, thus causing the ball to be misdirected.

After considerable research and experimentation, the racket of the present invention has been devised to compensate for the various undesirable actions and reactions resulting when the ball makes contact with the racket anywhere but the center or sweet spot, the racket of the present invention comprising, essentially, a frame within which is strung a plurality of string elements interconnected in such a manner to provide substantially concave surfaces on each face of the racket head.

BRIEF DESCRIPTION OF THE DRAWINGS

FIG. 1 is a fragmentary plan view of the racket of the present invention;

FIG. 2 is a sectional view taken along line 2—2 of FIG. 1;

FIG. 3 is a sectional view taken along line 3—3 of FIG. 1;

FIG. 4 is a sectional view taken along 4—4 of FIG. 1;

DESCRIPTION OF THE PREFERRED EMBODIMENTS

Figure 8:
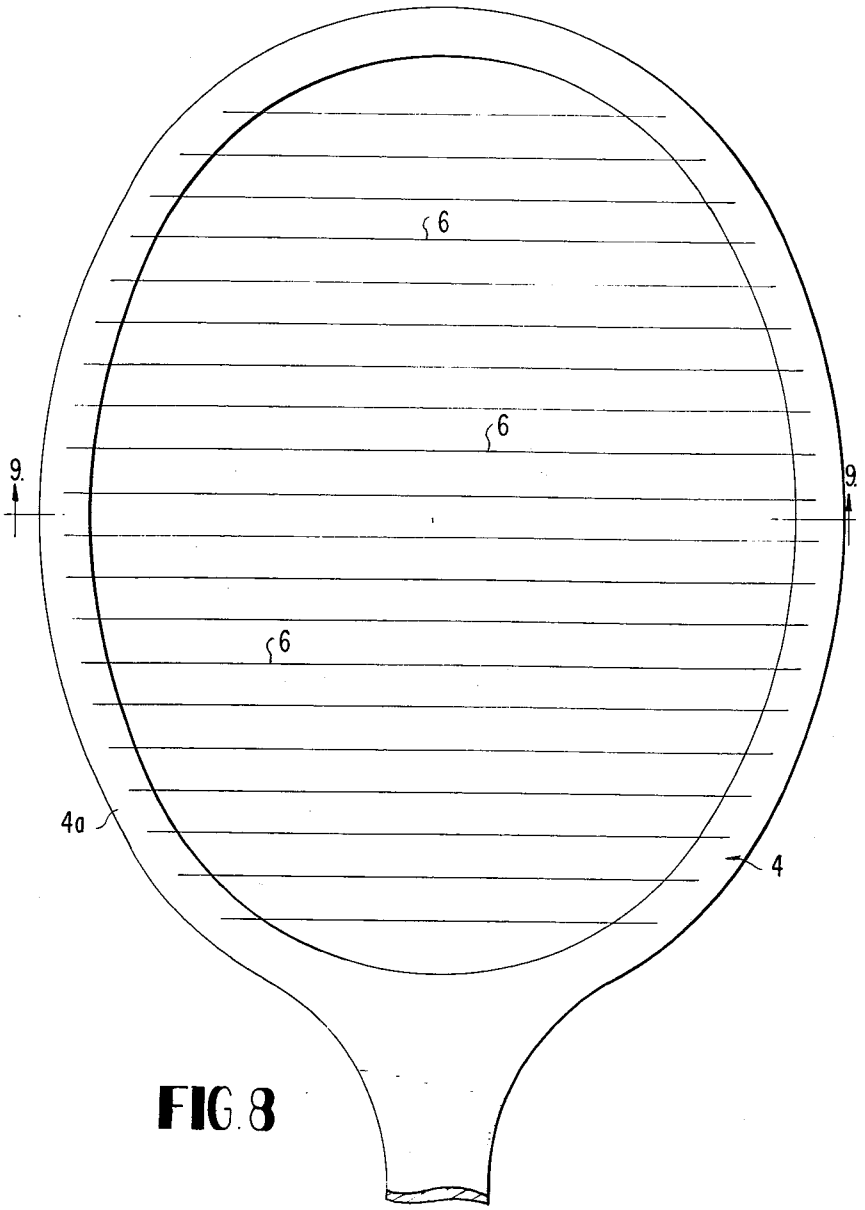
FIG. 8 is a fragmentary, plan view of a partially strung racket having a wooden frame.

Referring to the drawings and more particularly to FIG. 1 thereof, the racket of the present invention comprises a handle or grip 1 connected to one end of a racket shaft portion 2, the opposite end of the shaft portion having a racket head 3 connected thereto, the racket head including a frame 4 within which is strung a plurality of string elements designated generally by reference numeral 5, the string elements being interconnected in such a manner to provide substantially concave ball-engaging surfaces on each face of the racket head, to be described more fully hereinafter.

Figure 9:
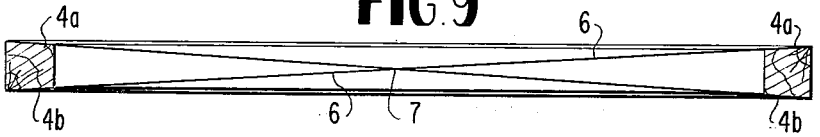
FIG. 9 is a sectional view taken along line 9—9 of FIG. 8.

The particular construction of the racket frame forms no part of the present invention, and while the racket frame shown in FIG. 1 is of metal construction, it can also be of wood construction as shown in FIGS. 8 and 9. Furthermore, while for purposes of illustration, the strung concave surfaces are being described for a tennis racket, it will be understood that the inventive concept can be used in other types of sports rackets such as, paddle ball, racket ball, table tennis, squash, and the like.

Figure 5:
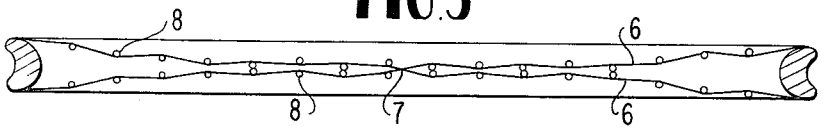
FIG. 5 is a sectional view taken along line 5—5 of FIG. 1.
Figure 6:
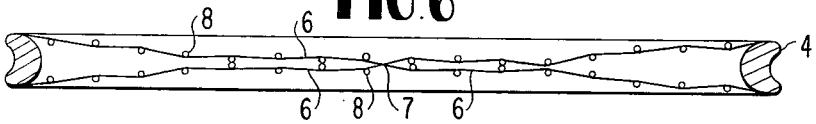
FIG. 6 is a sectional view taken along line 6—6 of FIG. 1.
Figure 7:
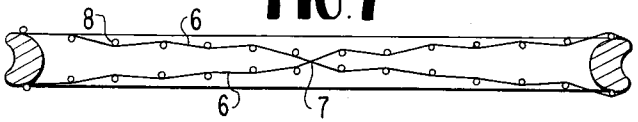
FIG. 7 is a sectional view taken along line 7—7 of FIG. 1.

To form the concave surfaces on each face of the strung portion of the racket, as will be seen in FIGS. 8 and 9, a plurality of tensioned string elements 6 extend transversely across the frame and extend from the upper surface **4*a* of one side of the frame to the diametrically opposite side of the frame to the lower surface 4*b* of the frame, the string elements intersecting as at 7 along the longitudinal axis of the frame 4. The strings 6 may be separate elements or a continuous element wound back and forth around the frame. When stringing a wooden frame, the upper and lower surfaces 4*a* and 4*b* thereof are provided with a slight taper or slope to enhance the slope or inclination of the strings, while in the case of a metal frame, as shown in FIGS. 5 and 6**, the curvature thereof inherently provides the desired slope.

After the transverse strings 6 are strung on the frame 4, the longitudinal strings 8 are interwoven and tensioned therewith. When interweaving the strings 6 and 8, as will be seen in FIGS. 2, 3 and 4, the weave is such that portions of the transverse strings 6 on each face are caused to abut in the central area of the racket to form the sweet spot indicated generally by 9 which is the area within the boundaries of the broken lines 10, shown in FIG. 1. As will be seen in FIGS. 5 and 6, the portions of the longitudinal strings 8 are also caused to substantially abut in this area.

Referring to FIGS. 2 to 7, in the area of the racket face, radially outwardly of the sweet spot 9, bounded by lines 10, the remaining portions of strings 6 and 8 on one face of the racket are caused to become spaced from their respective strings on the opposite face of the racket, the amount of the spacing becoming progressively greater in the direction of the frame 4. By the construction and arrangement of the interweaving of the strings 6 and 8, a substantially flat area is provided in the sweet spot area 9, and a sloped area is provided outside the perimeter of the sweet spot area 9, thereby forming a substantially concave ball-engaging surface on each face of the racket head.

While the concave ball-engaging surfaces of the present invention have been described as being formed by weaving the longitudinal and transverse strings, it will be appreciated by those skilled in the art that the concave ball-engaging surfaces could also be formed by not interweaving the strings and tying the two faces together at various points and distances to obtain the desired concavity for each face.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A sports racket comprising a head having a frame, a plurality of transversely and longitudinally extending string elements mounted within and connected to said frame to form a ball-engaging surface on each face of the racket, said string elements being interconnected in such a manner to form a substantially flat surface in the sweet spot area on each face of the racket disposed radially inwardly a substantial distance from the periphery of the frame, and a sloped surface on each face of the racket extending radially outwardly from the perimeter of the sweet spot area to said frame, thereby forming substantially concave ball-engaging surfaces on each face of the racket head, whereby various undesirable actions and reactions occasioned by a ball striking the face of the racket anywhere but on the sweet spot are compensated.

2. A sports racket according to claim 1, wherein the transversely and longitudinally extending string elements are interwoven.

3. A sports racket according to claim 2, wherein the transverse strings extend from the upper surface on one side of the frame to the opposite side of the frame to the lower surface thereof, said transverse string elments intersecting at the longitudinal axis of the frame.

4. A sports racket according to claim 3, wherein portions of the longitudinal and transverse strings on one face of the racket abut their respective string portions on the opposite face of the racket to form the sweet spot in the center of the racket head, the remaining portions of the longitudinal and transverse strings on one face of the racket being spaced from the respective portions of the longitudinal and transverse strings on the opposite face of the racket, the spacing of the strings becoming progressively greater from the sweet spot area to the frame to thereby form a sloped surface.

5. A sports racket according to claim 1, wherein the frame is constructed of wood, the upper surface of the wooden frame being sloped toward the center of the area enclosed by the frame, and the lower surface of the frame being inclined toward the center of the area enclosed by the frame.

* * * * *